US012698732B2

(12) United States Patent
Zurface et al.

(10) Patent No.: US 12,698,732 B2
(45) Date of Patent: Aug. 4, 2026

(54) HYDRAULIC CAPSULE FOR VARIABLE VALVE ACTUATION

(71) Applicant: Eaton Intelligent Power Limited, Dublin (IE)

(72) Inventors: Austin R. Zurface, Dowling, MI (US); Zdeněk Hübner, Horoušánky (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/802,651

(22) Filed: Aug. 13, 2024

(65) Prior Publication Data

US 2024/0401508 A1 Dec. 5, 2024

Related U.S. Application Data

(63) Continuation of application No. PCT/EP2023/025119, filed on Mar. 15, 2023.
(Continued)

(51) Int. Cl.
*F01L 1/24* (2006.01)
*F01L 1/18* (2006.01)
(Continued)

(52) U.S. Cl.
CPC ..... *F01L 1/2416* (2013.01); *F01L 1/182* (2013.01); *F01L 1/26* (2013.01); *F01L 13/06* (2013.01)

(58) Field of Classification Search
CPC . F01L 1/2416; F01L 1/182; F01L 1/18; F01L 1/181; F01L 1/26; F01L 1/267;
(Continued)

(56) References Cited

U.S. PATENT DOCUMENTS 8,851,048 B2 10/2014 Meistrick
10,690,024 B2 6/2020 Vanwingerden
(Continued)

FOREIGN PATENT DOCUMENTS

CN 104500164 A 4/2015
WO WO-2020104057 A1 * 5/2020 ..... F01L 13/065

OTHER PUBLICATIONS

International search report and Written Opinion received for PCT Application No. PCT/US/EP2023/025119, 12 pages, Jun. 13, 2023.

*Primary Examiner* — Devon C Kramer
*Assistant Examiner* — Kelsey L Stanek
(74) *Attorney, Agent, or Firm* — Meunier Carlin & Curfman LLC

(57) ABSTRACT

A rocker arm assembly includes an engine brake capsule assembly. The engine brake capsule assembly is movable between a retracted position and an extended position to selectively engage a valve bridge to open a first exhaust valve. The engine brake capsule assembly includes an outer housing including a lower chamber and a plunger. The plunger extends out below the outer housing. The engine brake capsule assembly further includes a check ball valve assembly disposed within the lower chamber configured to selectively enable a hydraulic fluid into the lower chamber and an oil channel fluidly coupled to the lower chamber and configured to direct a flow of the hydraulic fluid out of the lower chamber. The engine brake capsule assembly further includes a spool valve configured to selectively block the oil channel.

18 Claims, 7 Drawing Sheets

Related U.S. Application Data

(60) Provisional application No. 63/319,870, filed on Mar. 15, 2022.

(51) Int. Cl.
*F01L 1/26* (2006.01)
*F01L 13/06* (2006.01)

(58) Field of Classification Search
CPC . F01L 1/2411; F01L 1/24; F01L 13/06; F01L 13/065; F01L 13/0031; F01L 2305/00; F01L 2001/2444; F01L 2001/2438
USPC ..... 123/90.39, 90.45
See application file for complete search history.

(56) References Cited

U.S. PATENT DOCUMENTS

| | | | | |
|---|---|---|---|---|
| 10,871,086 | B2 * | 12/2020 | Andrisani | F01L 1/24 |
| 2014/0182536 | A1 * | 7/2014 | Yang | F01L 1/08 123/90.39 |
| 2018/0298795 | A1 * | 10/2018 | Cecur | F01L 13/06 |
| 2021/0131315 | A1 * | 5/2021 | Sarati | F01L 1/047 |
| 2021/0285343 | A1 * | 9/2021 | VanWingerden | F01L 9/20 |

* cited by examiner

HYDRAULIC CAPSULE FOR VARIABLE VALVE ACTUATION

PRIORITY

This application claims the benefit under 35 U.S.C. § 365(c) of International Patent Application No. PCT/EP2023/025119, filed 15 Mar. 2023, which claims the benefit under 35 U.S.C. § 119(e) of U.S. Provisional Patent Application No. 63/319,870, filed 15 Mar. 2022, all of which are incorporated herein by reference.

TECHNICAL FIELD

The present disclosure relates generally to variable valve actuation and, more particularly, to an improved hydraulic capsule for variable valve actuation.

BACKGROUND

Internal combustion engines typically use either a mechanical, electrical, or hydro-mechanical valve actuation system to actuate the engine valves. These systems may include a combination of camshafts, rocker arms and push rods that are driven by the engine's crankshaft rotation. In a typical valvetrain assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. Existing engine brake actuators may experience impact loading and failure between a latch pin and seeger clip when pressurized during a braking mode.

SUMMARY OF PARTICULAR EMBODIMENTS

In particular embodiments, a rocker assembly includes: a rocker arm including a valve end, the valve end including an actuator bore; and an engine brake capsule assembly in the actuator bore. The engine brake capsule assembly is movable between a retracted position and an extended position. In the retracted position the engine brake capsule assembly does not engage a valve bridge, and in the extended position the engine brake capsule assembly selectively engages the valve bridge to open a first exhaust valve. The engine brake capsule assembly includes: an outer housing including a lower chamber; a plunger defining a bottom end of the lower chamber, the plunger extends out below the outer housing; a check ball valve assembly disposed within the lower chamber configured to selectively enable a hydraulic fluid into the lower chamber to move the plunger from the retracted position to the extended position; an oil channel fluidly coupled to the lower chamber and configured to direct a flow of the hydraulic fluid out of the lower chamber during a transition from the extended position to the retracted position; and a spool valve configured to selectively block the oil channel.

In particular embodiments, the outer housing further includes a first bore disposed along a horizontal plane and configured to receive the hydraulic fluid from a rocker shaft. The rocker shaft is disposed through a center pivot bore of the rocker arm.

In particular embodiments, the lower chamber is fluidly coupled to the first bore. The check ball valve assembly is configured to allow the hydraulic fluid into the lower chamber as the hydraulic fluid is introduced into the first bore.

In particular embodiments, the spool valve is disposed within the first bore coupled to a spring disposed at an end of the first bore.

In particular embodiments, the rocker assembly further includes a plug disposed at the end of the first bore configured to seal the end of the first bore.

In particular embodiments, the spool valve is configured to compress the spring and translate along the first bore as a flow of the hydraulic fluid is introduced into the outer housing.

In particular embodiments, the spool valve is configured to block the oil channel and rest against the end of the first bore in response to an increase in pressure based on introduction of the hydraulic fluid.

In particular embodiments, the spring is configured to expand and translate the spool valve back along the first bore in response to a decrease in pressure based on a reduction of the flow of the hydraulic fluid, thereby opening the oil channel to reduce a pressure within the lower chamber.

In particular embodiments, the outer housing further includes an upper chamber having an inlet. The first bore is disposed between the upper chamber and the lower chamber. The oil channel fluidly couples the upper chamber and the lower chamber.

In particular embodiments, the outer housing further includes a central bore and a connecting pathway. The central bore is disposed along a central axis of the outer housing and fluidly couples the upper chamber and the lower chamber. The connecting pathway is disposed between the inlet and the first bore.

In particular embodiments, the inlet is configured to receive the hydraulic fluid from the rocker shaft and direct the hydraulic fluid into the upper chamber and to the first bore through the connecting pathway.

In particular embodiments, a valvetrain assembly includes: a first engine valve; a second engine valve; a valve bridge operatively associated with the first engine valve and the second engine valve; and a combined exhaust and engine brake rocker arm assembly configured to selectively open the first engine valve and the second engine valve. The rocker arm assembly includes: a rocker arm including a valve end, the valve end including a first actuator bore; and an engine brake capsule assembly in the first actuator bore. The engine brake capsule assembly is movable between a retracted position and an extended position. In the retracted position the engine brake capsule assembly does not engage the valve bridge, and in the extended position the engine brake capsule assembly selectively engages the valve bridge to open the first engine valve. The engine brake capsule assembly includes: an outer housing including a lower chamber; a plunger defining a bottom end of the lower chamber, the plunger extends out below the outer housing; a check ball valve assembly disposed within the lower chamber configured to selectively enable a hydraulic fluid into the lower chamber to move the plunger from the retracted position to the extended position; an oil channel fluidly coupled to the lower chamber and configured to direct a flow of the hydraulic fluid out of the lower chamber during a transition from the extended position to the retracted position; and a spool valve configured to selectively block the oil channel.

In particular embodiments, the outer housing further includes a first bore disposed along a horizontal plane and configured to receive the hydraulic fluid from a rocker shaft. The rocker shaft is disposed through a center pivot bore of the rocker arm.

In particular embodiments, the lower chamber is fluidly coupled to the first bore. The check ball valve assembly is configured to allow the hydraulic fluid into the lower chamber as the hydraulic fluid is introduced into the first bore.

In particular embodiments, the spool valve is disposed within the first bore coupled to a spring disposed at an end of the first bore.

In particular embodiments, the spool valve is configured to compress the spring and translate along the first bore as a flow of the hydraulic fluid is introduced into the outer housing.

In particular embodiments, the spool valve is configured to block the oil channel and rest against the end of the first bore in response to an increase in pressure based on introduction of the hydraulic fluid.

In particular embodiments, the spring is configured to expand and translate the spool valve back along the first bore in response to a decrease in pressure based on a reduction of the flow of the hydraulic fluid, thereby opening the oil channel to reduce a pressure within the lower chamber.

In particular embodiments, the outer housing further includes: an upper chamber including an inlet, the first bore is disposed between the upper chamber and the lower chamber, and the oil channel fluidly couples the upper chamber and the lower chamber; a central bore; and a connecting pathway. The central bore is disposed along a central axis of the outer housing and fluidly couples the upper chamber and the lower chamber. The connecting pathway is disposed between the inlet and the first bore.

In particular embodiments, the inlet is configured to receive the hydraulic fluid from the rocker shaft and direct the hydraulic fluid into the upper chamber and to the first bore through the connecting pathway.

BRIEF DESCRIPTION OF THE DRAWINGS

The following figures are included to illustrate certain aspects of the present disclosure and should not be viewed as exclusive embodiments. The subject matter disclosed is capable of considerable modifications alterations combinations, and equivalents in form and function, without departing from the scope of this disclosure.

DESCRIPTION OF EXAMPLE EMBODIMENTS

Figure 1:
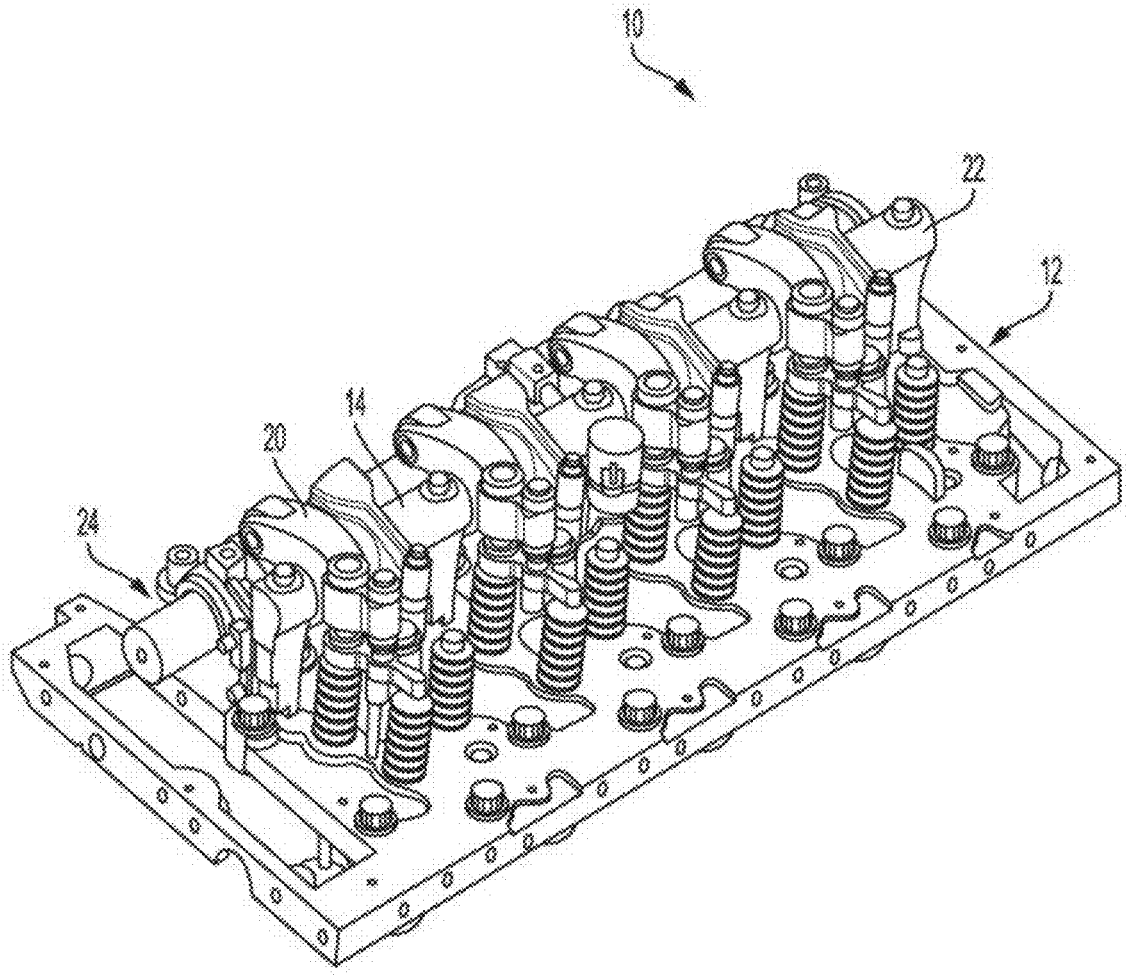
FIG. 1 illustrates a perspective view of a valve train assembly incorporating a rocker arm assembly that includes an intake rocker arm assembly and a combined exhaust rocker arm assembly and engine brake rocker arm assembly, according to one or more aspects of the present disclosure.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". In the figures and the description, like numerals are intended to represent like elements.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

To facilitate a better understanding of the present disclosure, the following examples of certain embodiments are given. In no way should the following examples be read to limit, or define, the scope of the disclosure. Embodiments described below with respect to one implementation are not intended to be limiting.

Figure 2:
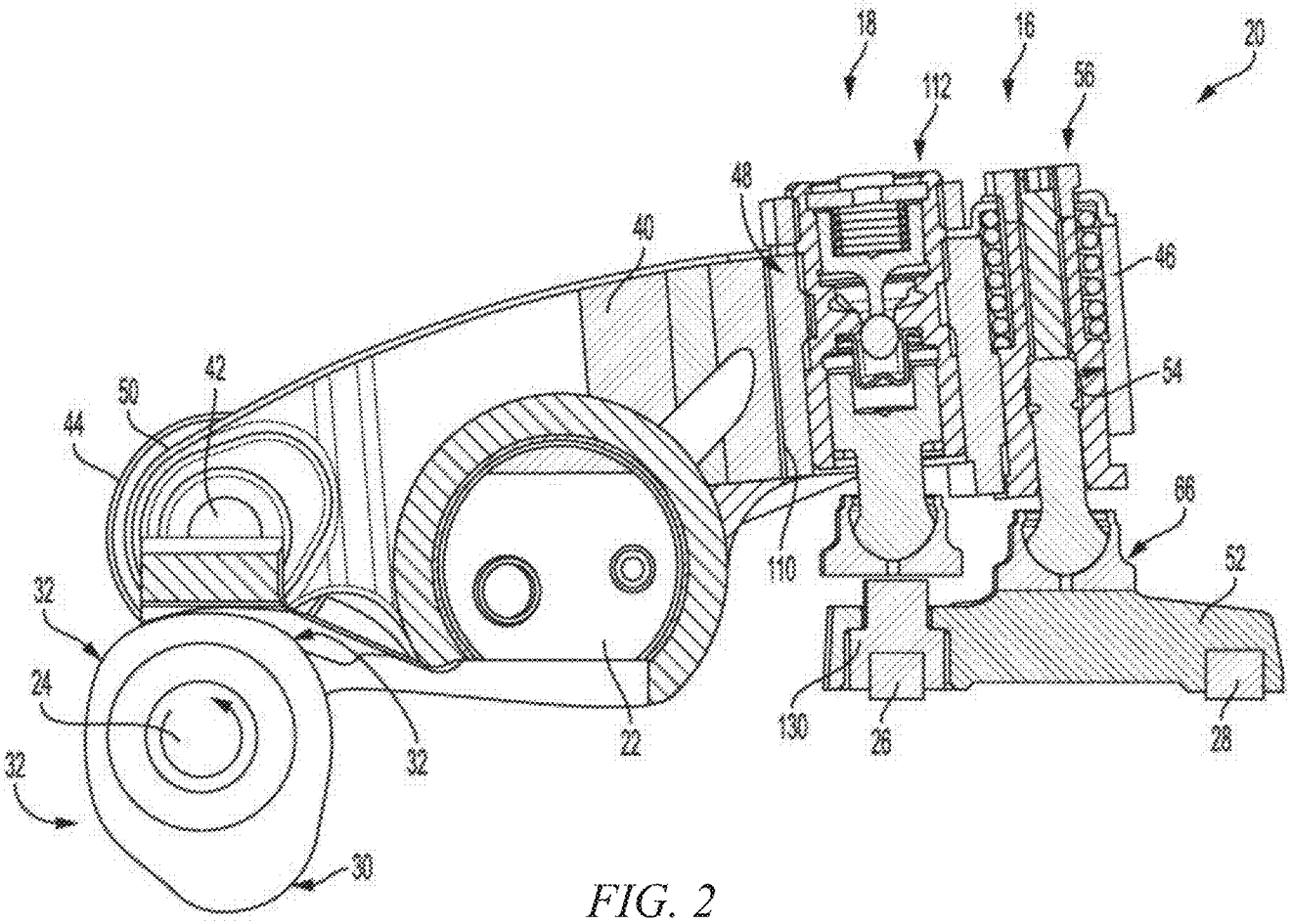
FIG. 2 illustrates a cross-sectional view of the combined rocker arm assembly shown in FIG. 1, according to one or more aspects of the present disclosure.

With initial reference to FIGS. 1 and 2, a valvetrain assembly constructed in accordance to one example of the present disclosure is shown and generally identified at reference 10. The valvetrain assembly 10 utilizes engine braking and is shown for use in a four-cylinder engine, but it will be appreciated the features described herein may be used in any valvetrain assembly that utilizes engine braking. The valvetrain assembly 10 may be supported in a valvetrain carrier 12 and can include two rocker arms per cylinder.

Specifically, each cylinder may include an intake valve rocker arm assembly 14, an exhaust rocker arm assembly 16, and an engine brake rocker arm assembly 18. However, as illustrated, the exhaust valve rocker arm assembly 16 and the engine brake rocker arm assembly 18 may be combined into a single rocker arm and are collectively referred to as a combined exhaust and engine brake rocker arm assembly 20, which cooperates to control opening of both of the exhaust valves. The present disclosure is not limited to such embodiments and may include separate rocker arm assemblies for the exhaust rocker arm assembly 16 and engine brake rocker arm assembly 18. The intake valve rocker arm assembly 14 may be configured to control motion of the intake valves, the exhaust valve rocker arm assembly 16 may be configured to control exhaust valve motion in a drive mode, and the engine brake rocker arm assembly 18 may be configured to act on one of the two exhaust valves in an engine brake mode, as will be described herein.

A rocker shaft 22 may be received by the valvetrain carrier 12 and may support rotation of the combined exhaust and engine brake rocker arm assembly 20. As described herein, the rocker shaft 22 may communicate oil to the assemblies 16, 18 during operation. A cam shaft 24 may include lift profiles or cam lobes configured to rotate assemblies 16, 18 to activate first and second exhaust valves 26 and 28, as is described herein in more detail. For example, FIG. 2 illustrates cam shaft 24 with an exhaust event lift profile or lobe 30 and a brake event lift profile or lobe 32, which may respectively cause combined rocker arm assembly 20 to operate in a drive mode and an engine brake mode.

The combined exhaust and engine brake rocker arm assembly 20 may generally include a rocker arm body 40, an axle 42, and a roller 44. The rocker arm body 40 may include an exhaust rocker arm portion 46, and an engine brake arm portion 48. Rocker arm body 40 may receive the rocker shaft 22 and defines a pair of flanges 50 to receive the axle 42 such that roller 44 is positioned at least partially therebetween. As such, the axle 42 may be coupled to the rocker arm body 40 and may receive the roller 44, which is configured to be engaged by the exhaust lift lobe 30 or engine brake lobe 32 of the cam shaft 24. This engagement of the roller 44 may cause combined rocker arm assembly 20 to rotate about rocker shaft 22 and engage a valve bridge assembly 52, as described herein in more detail.

The exhaust valve rocker arm assembly 16 may include exhaust rocker arm portion 46, which defines a bore 54 configured to at least partially receive a lost motion spigot assembly 56. When roller 44 is engaged by the exhaust lift profile 30, the exhaust rocker arm portion 46 and lost motion spigot assembly 56 may be rotated downward, causing downward movement of the valve bridge assembly 52, which engages the first and second exhaust valve 26 and 28 associated with a cylinder of an engine (not shown). The lost motion spigot assembly 56 may be configured to take up any lash between the lost motion spigot assembly 56 and the valve bridge assembly 52. In the example implementation, the lost motion exhaust spigot assembly 56 may generally include an e-foot 66 configured to engage with the valve bridge assembly 52.

With continued reference to FIG. 2, the engine brake arm portion 48 may define a bore 110 configured to at least partially receive an engine brake capsule assembly 112. When roller 44 is engaged by the engine brake lift profile 32, the engine brake rocker arm portion 48 and engine brake capsule assembly 112 may be rotated downward, causing downward movement of the valve bridge assembly 52, which engages only the first exhaust valve 26 (i.e., not valve 28).

In the example embodiment, engine brake capsule assembly 112 may configured to selectively move from a collapsing mode to a rigid mode to selectively transfer cam motion to the first exhaust valve 26 during an engine braking event (i.e., engine brake mode). As illustrated, an e-foot included in the engine brake capsule assembly 112 may be configured to act against a valve pin 130, which is slidingly disposed within the valve bridge assembly 52, wherein the valve pin 130 is configured to transfer force to the first exhaust valve 26.

Figure 3:
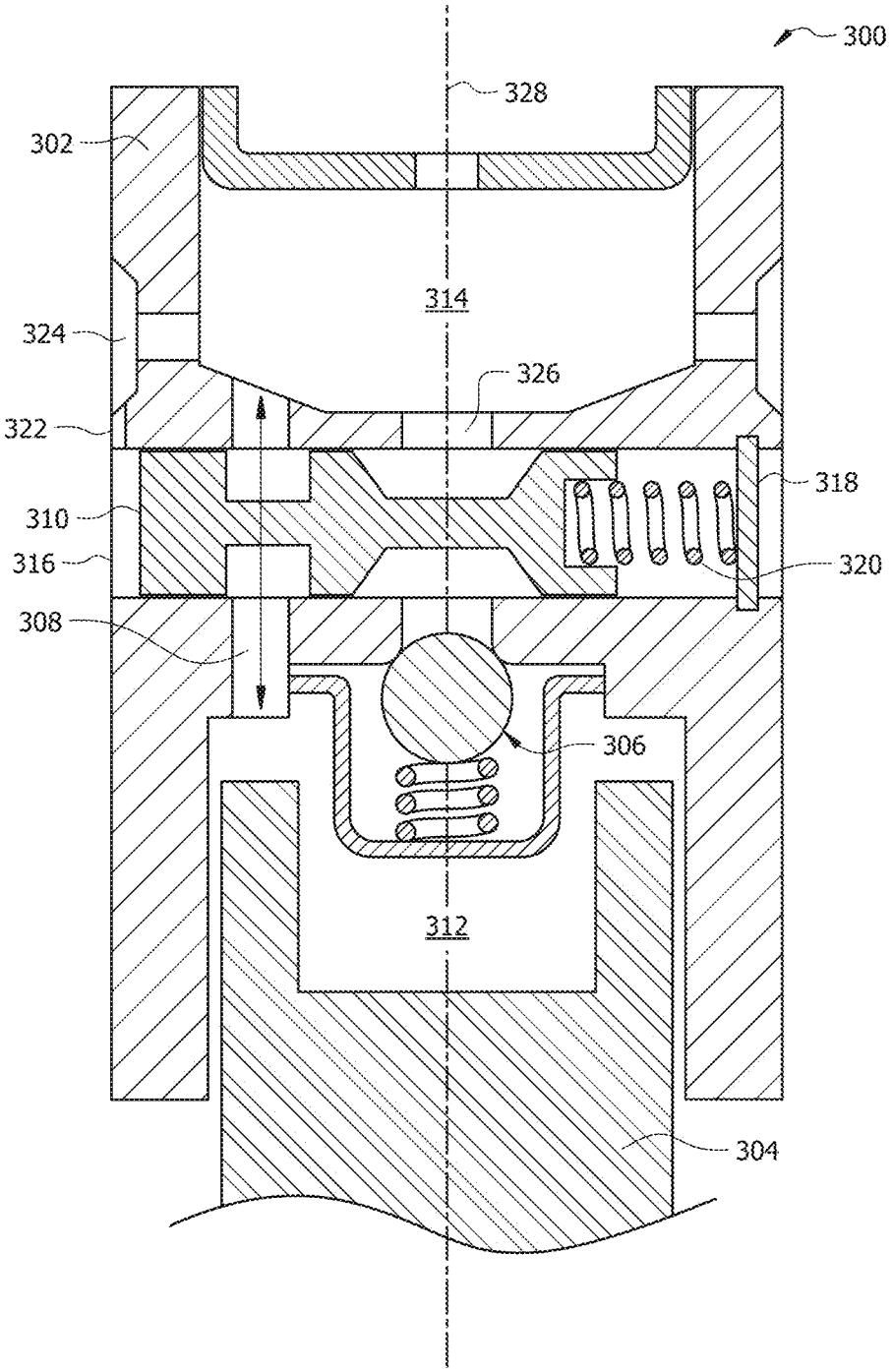
FIG. 3 illustrates a cross-sectional view of an engine brake capsule assembly of the combined rocker arm of FIG. 1 in a drive mode, according to one or more aspects of the present disclosure.
Figure 4:
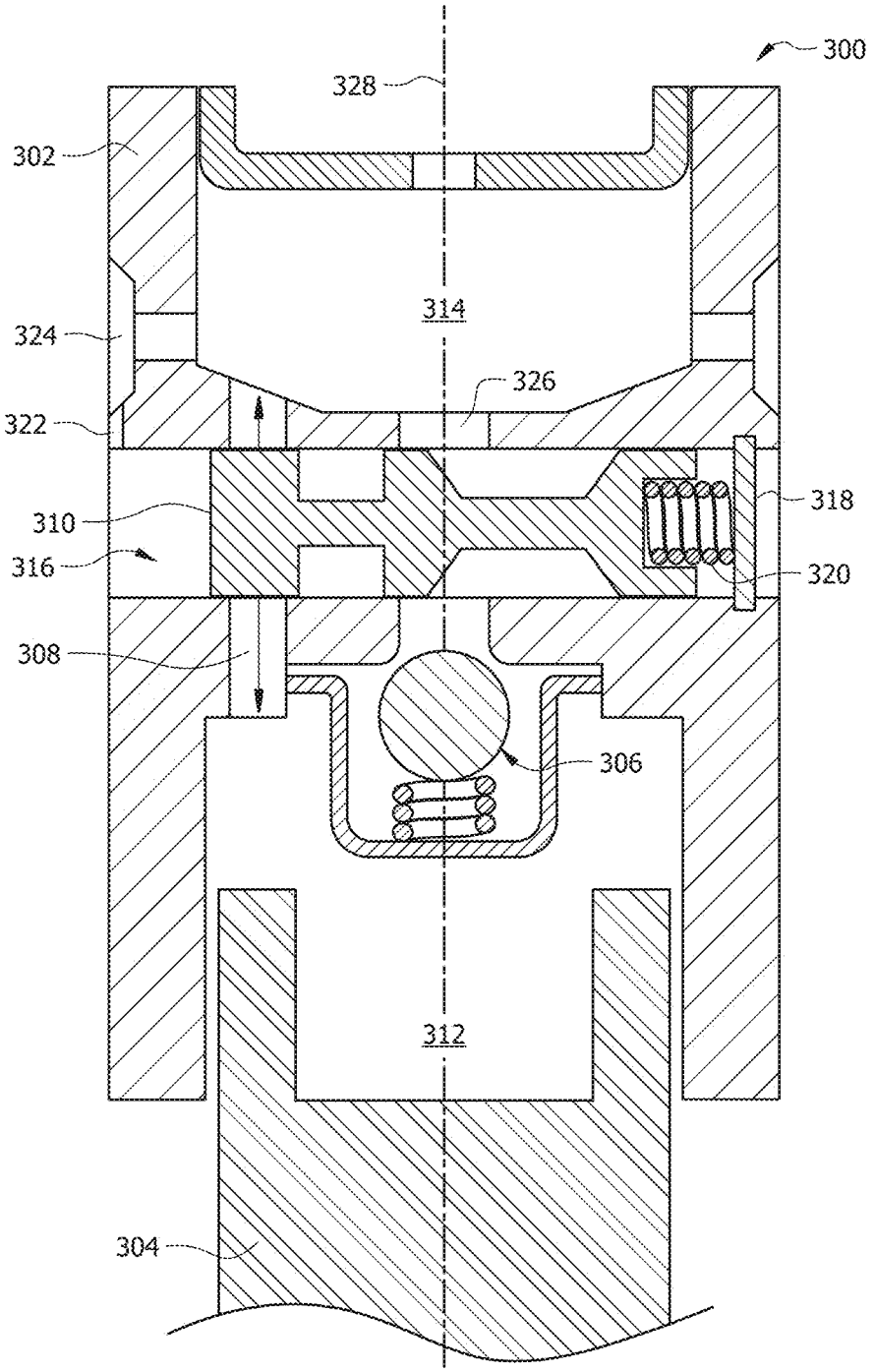
FIG. 4 illustrates a cross-sectional view of an engine brake capsule assembly of the combined rocker arm of FIG. 1 in an engine brake mode, according to one or more aspects of the present disclosure.

FIGS. 3-4 illustrate a cross-sectional view of an improved engine brake capsule assembly 300, according to one or more aspects of the present disclosure. FIG. 3 illustrates engine brake capsule assembly 300 in a drive mode, and FIG. 4 illustrates engine brake capsule assembly 300 in an engine brake mode. The present disclosure contemplates usage of combined exhaust and engine brake rocker arm assembly 20 (referring to FIGS. 1-2) with the engine brake capsule assembly 300. In previous embodiments, the engine brake capsule assembly 112 (referring to FIG. 2) may have included a seeger clip disposed above an actuation pin or latch, wherein there may have been impact loading and failure between the pin/latch and seeger clip when pressurized during an engine braking mode. The present embodiments of engine brake capsule assembly 300 may eliminate the need and use of a seeger clip and/or pin/latch and may reduce impact loads during operations.

The engine brake capsule assembly 300 may be configured to transition between a retracted position and an extended position, wherein in the retracted position the engine brake capsule assembly 300 does not engage a valve bridge (such as valve bridge assembly 52 illustrated in FIG. 2), and in the extended position, the engine brake capsule assembly 300 may selectively engage the valve bridge to open first exhaust valve 26 (referring to FIG. 2). The engine brake capsule assembly 300 may be any suitable size, height, shape, and any combinations thereof. Further, the engine brake capsule assembly 300 may comprise any suitable materials, such as metals, nonmetals, polymers, composites, and any combinations thereof.

The engine brake capsule assembly 300 may comprise an outer housing 302, a plunger 304, a check ball valve 306, an oil channel 308, and a spool valve 310. In embodiments, the outer housing 302 may be disposed within the bore 110 (referring to FIG. 2) of the engine brake arm portion 48 (referring to FIG. 2). The outer housing 302 may be configured to house and/or contain the components of the engine brake capsule assembly 300. As illustrated, the outer housing 302 may comprise a lower chamber 312, an upper chamber 314, and a first bore 316. The first bore 316 may be disposed through the outer housing 302 along a horizontal plane, wherein the lower chamber 312 may be disposed below the first bore 316, and wherein the upper chamber 314 may be disposed above the first bore 316. In embodiments, both the lower chamber 312 and upper chamber 314 are fluidly coupled to the first bore 316. Further, the oil channel 308 may be at least fluidly coupled to the lower chamber 312. In one or more embodiments, the oil channel 308 may additionally be fluidly coupled to the upper chamber 314 and may connect the lower chamber 312 to the upper chamber 314. During operations, the oil channel 308 may be configured to direct a flow of hydraulic fluid out of the lower chamber 312 during a transition from the extended position to the retracted position (i.e., from the engine brake mode to the drive mode).

The engine brake capsule assembly 300 may further comprise a plug 318 disposed at an end of the first bore 316 configured to seal that end, wherein an opposing end may be open and configured to receive a fluid. As shown, the spool valve 310 may be disposed within the first bore 316 operable to translate along a length of the first bore 316. The engine brake capsule assembly 300 may further comprise a spring 320 coupled to the plug 318, wherein the spool valve 310 may be disposed at an opposing end of the spring 320. The spool valve 310 may be operable to apply force against and compress the spring 320, and when there is a reduction in pressure, the spring 320 may be operable to expand and apply a force against the spool valve 310, thereby causing the spool valve 310 to move.

In embodiments, the first bore 316 may be configured to receive hydraulic fluid supplied by the rocker shaft 22 (referring to FIGS. 1-2), wherein the rocker shaft is disposed through the combined exhaust and engine brake rocker arm assembly 20. In the present embodiment, the first bore 316 may receive a flow of hydraulic fluid from the upper chamber 314 and through a connecting pathway 322, wherein both receive the hydraulic fluid supplied by the rocker shaft 22 through an inlet 324. As illustrated, the outer housing 302 may further comprise the inlet 324, wherein the inlet 324 may be fluidly coupled to the upper chamber 314. The connecting pathway 322 may be an off-shooting flow path connecting the inlet 324 to the first bore 316. There may be a central bore 326 defined within the outer housing 302, wherein the central bore 326 is disposed along a central axis 328 of the outer housing 302 and fluidly couples the upper chamber 314 and the lower chamber 312. In embodiments, the central bore 326 may intersect with first bore 316 and may be parallel to the oil channel 308.

During operations of combined exhaust and engine brake rocker arm assembly 20, the engine brake capsule assembly 300 may be actuated to transition between drive mode and engine brake mode. During drive mode, the spring 320 may bias the spool valve 310 to an initial or first position. In the illustrated initial position, the oil channel 308 is open, and there may be open fluid communication between the upper chamber 314 and lower chamber 312 through the oil channel 308. Transitioning to the engine brake mode may include introducing a flow of hydraulic fluid into the engine brake capsule assembly 300. As hydraulic fluid is introduced to the engine brake capsule assembly 300 via inlet 324, a portion of the hydraulic fluid may flow through the connecting pathway 322 into the first bore 316. The increasing pressure may force the spool valve 310 to translate along the first bore 316 and compress the spring 320 to rest at a second position. At this second position, the spool valve 310 may block the oil channel 308. The hydraulic fluid may then be directed to flow from the upper chamber 314 through the central bore 326 and towards the lower chamber 312.

As illustrated, the check ball valve 306 may be disposed at an upper portion of the lower chamber 312 and seated against the intersection of the central bore 326 with the lower chamber 312. The check ball valve 306 may be configured to selectively allow hydraulic fluid into the lower chamber to move the plunger 304 from a retracted position to an extended position, wherein the plunger 304 defines a bottom end of the lower chamber 312. During the drive mode, the check ball valve 306 may remain seated against the aforementioned intersection as fluid communication was enabled via the oil channel 308. As the oil channel 308 is blocked in the engine brake mode, the increased pressure due to the hydraulic fluid may activate the check ball valve 306 and unseat the check ball valve, thereby allowing a flow of hydraulic fluid into the lower chamber 312. As pressure increases within the lower chamber 312, the plunger 304 may be actuated to translate downwards from a retracted position to an extended position. The check ball valve 306 may return to a seated position once there is a negligible pressure differential between the upper and lower chambers 312, 314 and when the plunger 304 engages with the first exhaust valve 26. For example, as the plunger 304 engages with the first exhaust valve 26, the reaction force may increase the pressure within the lower chamber 312, thereby causing the check ball valve 306 to close. Operation of the combined exhaust and engine brake rocker arm assembly 20 may now include opening the first exhaust valve 26 with plunger 304, wherein the engine brake capsule assembly 300 may be in a rigid mode to selectively transfer cam motion to the first exhaust valve 26 during an engine braking event.

As the combined exhaust and engine brake rocker arm assembly 20 transitions from the engine brake mode back to the drive mode, the hydraulic fluid supplied to the engine brake capsule assembly 300 decreases. As the pressure acting against the spool valve 310 decreases, the spring 320 may expand and cause the spool valve 310 to translate back to the initial, first position, thereby opening the oil channel 308. The opened oil channel 308 may reduce the pressure within the lower chamber 312 and may direct the pressurized hydraulic fluid out of the lower chamber 312, and the plunger 304 may return back to a retracted position.

FIGS. 5A-5E illustrate a cross-sectional view of another improved engine brake capsule assembly 500 transitioning from a drive mode to an engine brake mode, according to one or more aspects of the present disclosure. The present disclosure contemplates usage of combined exhaust and engine brake rocker arm assembly 20 (referring to FIGS. 1-2) with the engine brake capsule assembly 500. Engine brake capsule assembly 500 may operate similarly as engine brake capsule assembly 300. Further, engine brake capsule assembly 500 may comprise the same or similar structures as engine brake capsule assembly 300. For example, engine brake capsule assembly 500 may comprise an outer housing 502, a plunger 504, a check ball valve 506, an oil channel 508, a spool valve 510, a spring 512, a plug 514, a lower chamber 516, and a first bore 518. Each of outer housing 502, plunger 504, check ball valve 506, oil channel 508, spool valve 510, spring 512, plug 514, lower chamber 516, and first bore 518 may operate and/or function similarly to outer housing 302 (referring to FIGS. 3-4), plunger 304 (referring to FIGS. 3-4), check ball valve 306 (referring to FIGS. 3-4), oil channel 308 (referring to FIGS. 3-4), spool valve 310 (referring to FIGS. 3-4), spring 320 (referring to FIGS. 3-4), plug 318 (referring to FIGS. 3-4), lower chamber 312 (referring to FIGS. 3-4), and first bore 316 (referring to FIGS. 3-4).

Engine brake capsule assembly 500 may operate without an upper chamber, central bore, connecting pathway, and any combinations thereof. During operations, hydraulic fluid may be introduced directly into the outer housing 502 via the first bore 518. While in a drive mode, the spring 512 may be expanded, and the spool valve 510 may be disposed in a first position abutting a shoulder 520 within the first bore 518. At the first position, the spool valve 510 may be blocking access to the check ball valve 506 within the lower chamber 516. Further, the oil channel 508 may be open and provide fluid communication between the lower chamber 516 and an external component.

Figure 5B:
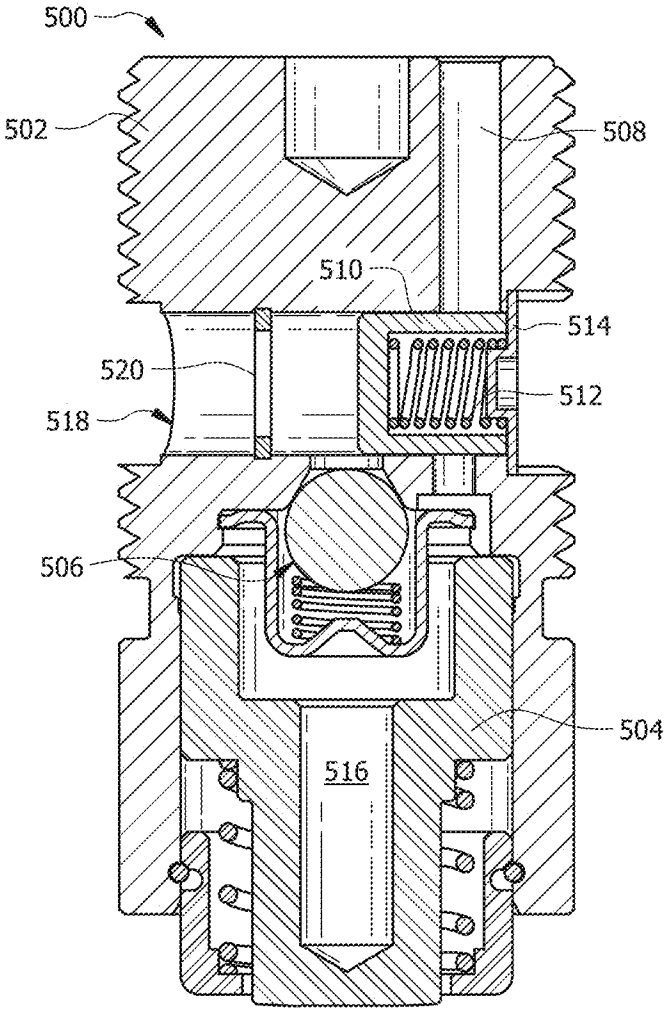
FIGS. 5A-5E illustrate cross-sectional views of an engine brake capsule assembly of the combined rocker arm of FIG. 1 transitioning from a drive mode to an engine brake mode, according to one or more aspects of the present disclosure.
Figure 5A:
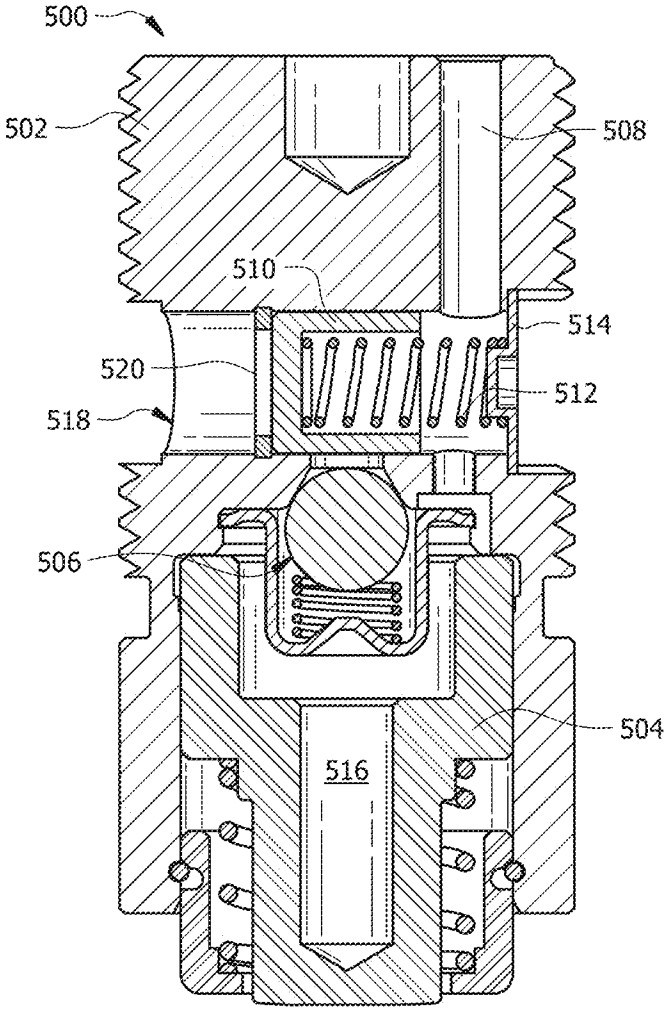
Figure 5D:
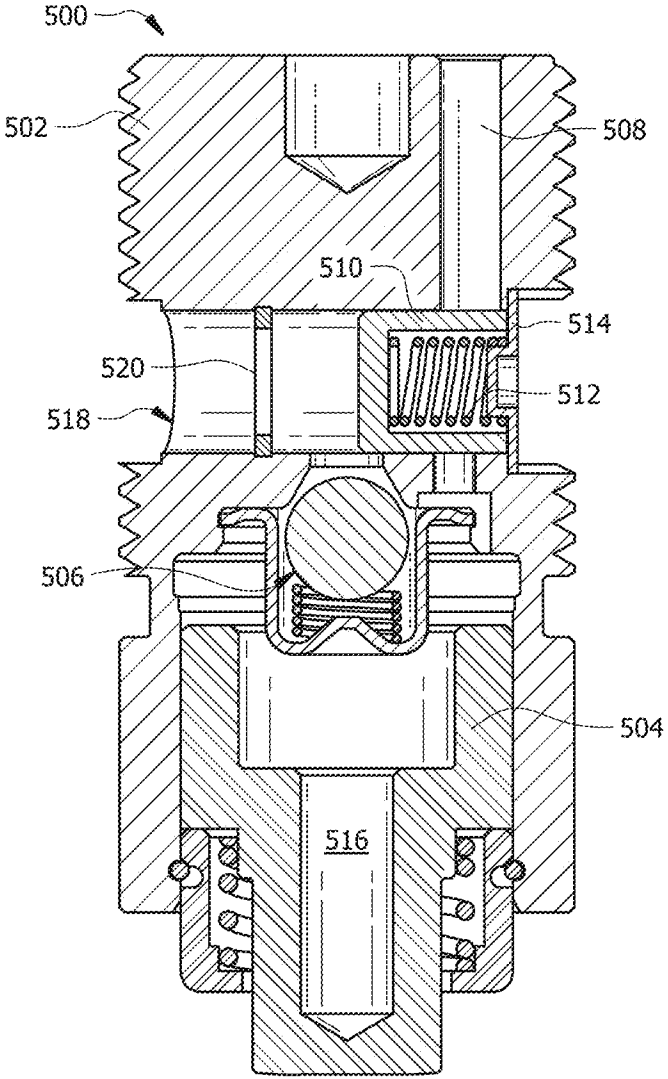
Figure 5C:
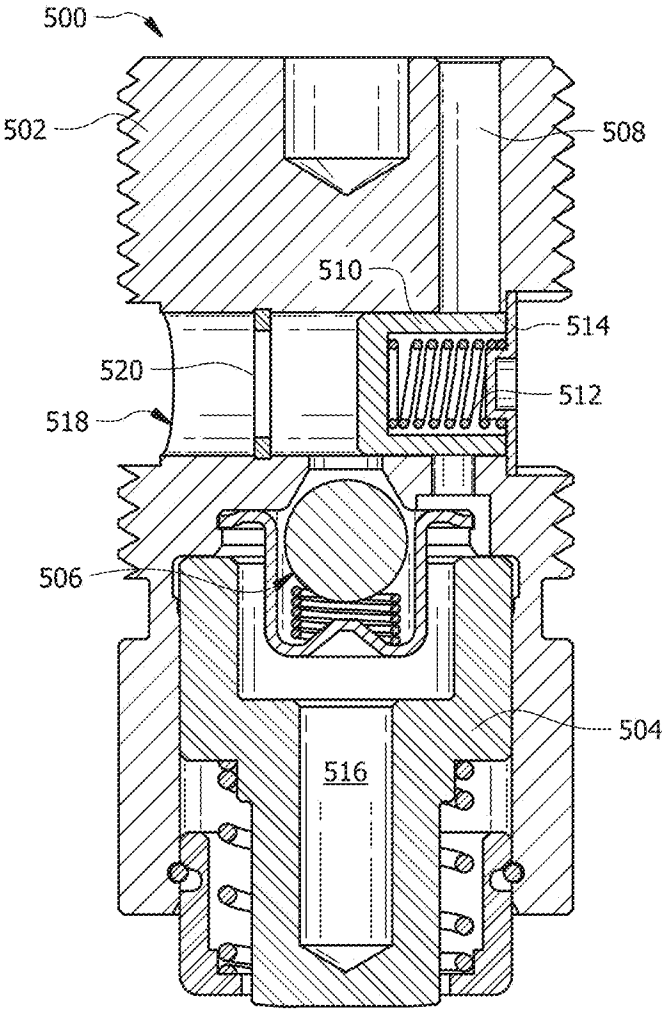
Figure 5E:
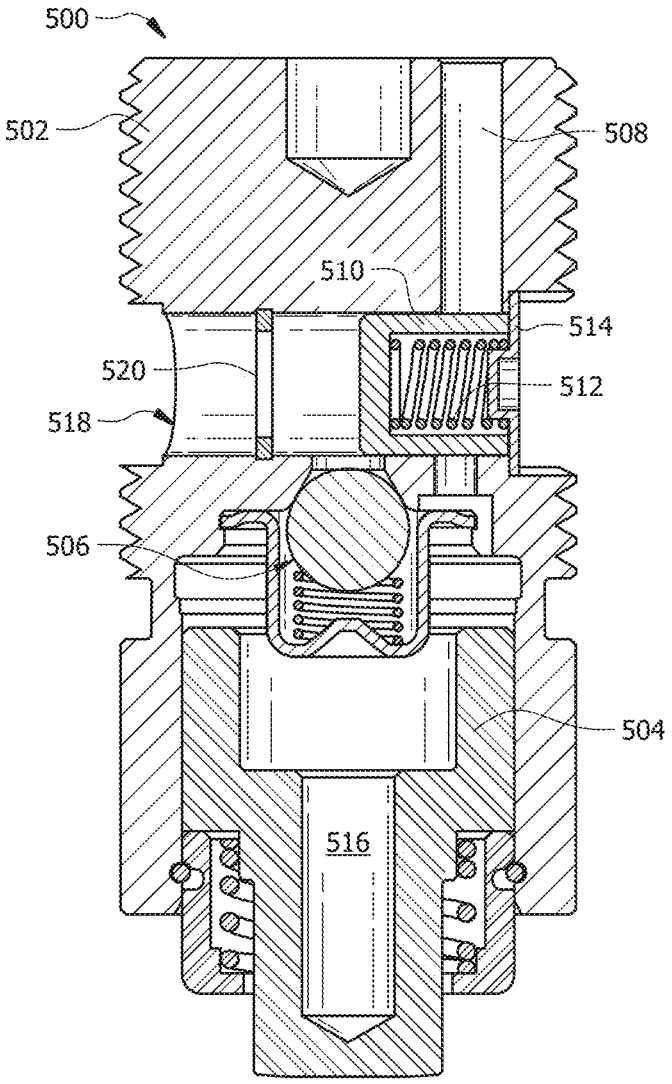

As the hydraulic fluid is introduced through the first bore 518 upon a transition to an engine brake mode, the spool valve 510 may be actuated to compress the spring 512 and to translate along the first bore 518, which may expose the check ball valve 506 to the introduced hydraulic fluid. As the pressure increases, the check ball valve 506 may be unseated (as best seen in FIG. 5C) and enable the introduction of hydraulic fluid into the lower chamber 516. As pressure increases within the lower chamber 516, the plunger 504 may be actuated to translate downwards from a retracted position to an extended position (as best seen in FIG. 5D). The check ball valve 506 may return to a seated position once there is a negligible pressure differential between the first bore 518 and the lower chamber 516 and when the plunger 504 engages with the first exhaust valve 26 (referring to FIG. 2). For example, as the plunger 504 engages with the first exhaust valve 26, the reaction force may increase the pressure within the lower chamber 516, thereby causing the check ball valve 506 to close (as best seen in FIG. 5E). Operation of the combined exhaust and engine brake rocker arm assembly 20 may now include opening the first exhaust valve 26 with plunger 504, wherein the engine brake capsule assembly 500 may be in a rigid mode to selectively transfer cam motion to the first exhaust valve 26 during an engine braking event.

As the combined exhaust and engine brake rocker arm assembly 20 transitions from the engine brake mode back to the drive mode, the hydraulic fluid supplied to the engine brake capsule assembly 500 decreases. As the pressure acting against the spool valve 510 decreases, the spring 512 may expand and cause the spool valve 510 to translate back to the initial, first position against the shoulder 520, thereby opening the oil channel 508. The opened oil channel 508 may reduce the pressure within the lower chamber 516 and may direct the pressurized hydraulic fluid out of the lower chamber 516, and the plunger 504 may return back to a retracted position.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A rocker assembly, comprising:

a rocker arm comprising a valve end which includes an actuator bore; and an engine brake capsule assembly disposed in the actuator bore, the engine brake capsule assembly configured to transition between (i) a retracted position in which the engine brake capsule assembly does not engage a valve bridge, and (ii) an extended position in which the engine brake capsule assembly selectively engages the valve bridge so as to open a first exhaust valve, the engine brake capsule assembly comprising:

an outer housing comprising:

a lower chamber, and a first bore disposed along a horizontal plane above the lower chamber;

a plunger defining a bottom end of the lower chamber, the plunger extending out below the outer housing;

a check ball valve assembly disposed within the lower chamber, the check ball valve assembly including a check ball valve configured to selectively enable a-hydraulic fluid to flow from the first bore into the lower chamber so as to extend the plunger during a transition of the engine brake capsule assembly from the retracted position to the extended position;

an oil channel extending through the outer housing, the oil channel configured to direct a flow of the hydraulic fluid out of the lower chamber so as to retract the plunger during a transition of the engine brake capsule assembly from the extended position to the retracted position; and a spool valve disposed within the first bore, the spool valve configured to translate along a length of the first bore between a first position and a second position such that:

in the first position, the spool valve blocks access to the check ball valve and opens the oil channel, and in the second position, the spool valve blocks the oil channel and exposes the check ball valve to the hydraulic fluid flowing from the first bore.

2. The rocker assembly of claim 1, wherein the first bore is configured to receive the hydraulic fluid from a rocker shaft, and wherein the rocker shaft is disposed through a center pivot bore of the rocker arm.

3. The rocker assembly of claim 1, wherein the first bore intersects the oil channel.

4. The rocker assembly of claim 1, wherein the spool valve is coupled to a spring disposed at an end of the first bore.

5. The rocker assembly of claim 4, wherein the engine brake capsule assembly further comprises a plug configured to seal the end of the first bore.

6. The rocker assembly of claim 4, wherein the spool valve is further configured to compress the spring as the hydraulic fluid is introduced into the first bore.

7. The rocker assembly of claim 6, wherein, in the second position, the spool valve is further configured to rest against the end of the first bore in response to an increase in pressure based on the introduction of the hydraulic fluid.

8. The rocker assembly of claim 7, wherein the spring is configured to expand and translate the spool valve back to the first position in response to a decrease in pressure based on a reduction of the hydraulic fluid.

9. The rocker assembly of claim 1, wherein the engine brake capsule assembly further comprises a shoulder disposed in the first bore, and wherein, in the first position, the spool valve is further configured to abut the shoulder.

10. A valvetrain assembly, comprising:

a first engine valve;

a second engine valve;

a valve bridge operatively associated with the first engine valve and the second engine valve; and a combined exhaust and engine brake rocker arm assembly configured to selectively open the first engine valve and the second engine valve, the combined exhaust and engine brake rocker arm assembly comprising:

a rocker arm comprising a valve end which includes a first actuator bore; and an engine brake capsule assembly disposed in the first actuator bore, the engine brake capsule assembly configured to transition between (i) a retracted position in which the engine brake capsule assembly does not engage the valve bridge, and (ii) an extended position in which the engine brake capsule assembly selectively engages the valve bridge so as to open the first engine valve, the engine brake capsule assembly comprising:

an outer housing comprising:

a lower chamber, and a first bore disposed along a horizontal plane above the lower chamber;

a plunger defining a bottom end of the lower chamber, the plunger extending out below the outer housing;

a check ball valve assembly disposed within the lower chamber, the check ball valve assembly including a check ball valve configured to selectively enable hydraulic fluid to flow from the first bore into the lower chamber so as to extend the plunger during a transition of the engine brake capsule assembly from the retracted position to the extended position;

an oil channel extending through the outer housing, the oil channel configured to direct a flow of the hydraulic fluid out of the lower chamber so as to retract the plunger during a transition of the engine brake capsule assembly from the extended position to the retracted position; and a spool valve disposed within the first bore, the spool valve configured to translate along a length of the first bore between a first position and a second position such that:

in the first position, the spool valve blocks access to the check ball valve and opens the oil channel, and in the second position, the spool valve blocks the oil channel and exposes the check ball valve to the hydraulic fluid flowing from the first bore.

11. The valvetrain assembly of claim 10, wherein the first bore is configured to receive the hydraulic fluid from a rocker shaft, and wherein the rocker shaft is disposed through a center pivot bore of the rocker arm.

12. The valvetrain assembly of claim 10, wherein the first bore intersects the oil channel.

13. The valvetrain assembly of claim 12, wherein the spool valve is coupled to a spring disposed at an end of the first bore.

14. The valvetrain assembly of claim 13, wherein the spool valve is further configured to compress the spring as the hydraulic fluid is introduced into the first bore.

15. The valvetrain assembly of claim 14, wherein, in the second position, the spool valve is further configured to rest against the end of the first bore in response to an increase in pressure based on the introduction of the hydraulic fluid.

16. The valvetrain assembly of claim 15, wherein the spring is configured to expand and translate the spool valve back to the first position in response to a decrease in pressure based on a reduction of the hydraulic fluid.

17. The valvetrain assembly of claim 13, wherein the engine brake capsule assembly further comprises a plug configured to seal the end of the first bore.

18. The valvetrain assembly of claim 10, wherein the engine brake capsule assembly further comprises a shoulder disposed in the first bore, and wherein, in the first position, the spool valve is further configured to abut the shoulder.

* * * * *